US007056596B2

(12) United States Patent
Kunitz et al.

(10) Patent No.: US 7,056,596 B2
(45) Date of Patent: Jun. 6, 2006

(54) METHOD FOR COATING A SURFACE OF A TRACK COMPONENT, IN ADDITION TO A TRACK COMPONENT

(75) Inventors: Walter Kunitz, Wildau (DE); Joachim Heilscher, Wusterwitz (DE); Stefan Schmedders, Butzbach (DE)

(73) Assignees: BWG GmbH & Co. KG, Butzbach (DE); Vae GmbH, Vienna (AU)

( * ) Notice: Subject to any disclaimer, the term of this patent is extended or adjusted under 35 U.S.C. 154(b) by 0 days.

(21) Appl. No.: 10/514,242

(22) PCT Filed: Jun. 26, 2003

(86) PCT No.: PCT/EP03/06782

§ 371 (c)(1),
(2), (4) Date: Nov. 22, 2004

(87) PCT Pub. No.: WO2004/003296

PCT Pub. Date: Jan. 8, 2004

(65) Prior Publication Data

US 2005/0208310 A1 Sep. 22, 2005

(30) Foreign Application Priority Data

Jun. 27, 2002 (DE) ..... 102 28 907
Feb. 12, 2003 (DE) ..... 103 13 957

(51) Int. Cl.

| | |
|---|---|
| ***B32B 15/01*** | (2006.01) |
| ***B32B 15/18*** | (2006.01) |
| ***B32B 15/20*** | (2006.01) |
| ***B05D 1/08*** | (2006.01) |
| ***C23C 4/08*** | (2006.01) |
| ***C23C 4/12*** | (2006.01) |

(52) U.S. Cl. ..... 428/653; 428/684; 427/446; 427/450; 427/452; 427/456

(58) Field of Classification Search ..... None
See application file for complete search history.

(56) References Cited

U.S. PATENT DOCUMENTS

| | | | | |
|---|---|---|---|---|
| 5,022,455 A | | 6/1991 | Takeda et al. | |
| 5,827,573 A | * | 10/1998 | Tsai | 427/327 |
| 5,958,521 A | * | 9/1999 | Zaluzec et al. | 427/449 |
| 6,080,360 A | * | 6/2000 | Pfeffinger et al. | 420/534 |
| 6,123,999 A | * | 9/2000 | Felix et al. | 427/449 |
| 6,165,286 A | * | 12/2000 | Bayer et al. | 148/220 |
| 6,315,844 B1 | * | 11/2001 | Ratz et al. | 148/581 |

(Continued)

FOREIGN PATENT DOCUMENTS

DE 3 709126 10/1988

(Continued)

OTHER PUBLICATIONS

372024, Apr. 1995, RD, N/A.*

*Primary Examiner*—Jason L. Savage
(74) *Attorney, Agent, or Firm*—Dennison, Schultz, Dougherty & MacDonald

(57) ABSTRACT

A method for coating a surface of a track component with a coating containing aluminum by means of an arc spraying process. In order to form a coating that exhibits a high resistance to sliding and abrasive wear, aluminum and silicon are applied to the surface in a ratio of 3:2 ≦Al:Si≦4:1 by an arc spraying process.

19 Claims, 1 Drawing Sheet

U.S. PATENT DOCUMENTS

| | | | | |
|---|---|---|---|---|
| 6,337,141 | B1 * | 1/2002 | Yamada et al. | 428/553 |
| 6,361,877 | B1 * | 3/2002 | Miyai et al. | 428/546 |
| 6,531,089 | B1 * | 3/2003 | Brungs et al. | 419/28 |
| 6,541,127 | B1 * | 4/2003 | Tomikawa et al. | 428/652 |
| 6,554,992 | B1 * | 4/2003 | Smith | 205/732 |
| 6,634,179 | B1 * | 10/2003 | Heinemann et al. | 62/62 |

FOREIGN PATENT DOCUMENTS

| | | | |
|---|---|---|---|
| DE | 3 743368 | | 7/1989 |
| DE | 19 711756 | | 9/1998 |
| DE | 19 721818 | | 12/1998 |
| DE | 20005454 | * | 7/2001 |
| DE | 10 028820 | | 1/2002 |
| DE | 10041638 | * | 3/2002 |
| EP | 0 446978 | | 9/1991 |
| FR | 2 197730 | | 3/1974 |
| JP | 56 102546 | | 8/1981 |
| JP | 56 166368 | | 12/1981 |
| JP | 62 001851 | | 1/1987 |
| JP | 11 336659 | | 12/1999 |
| JP | 2000 212718 | | 7/2000 |
| JP | 2001205340 | * | 7/2001 |
| JP | 2002004025 | * | 1/2002 |
| WO | 9 947724 | | 9/1999 |
| WO | 0 171053 | | 9/2001 |

* cited by examiner

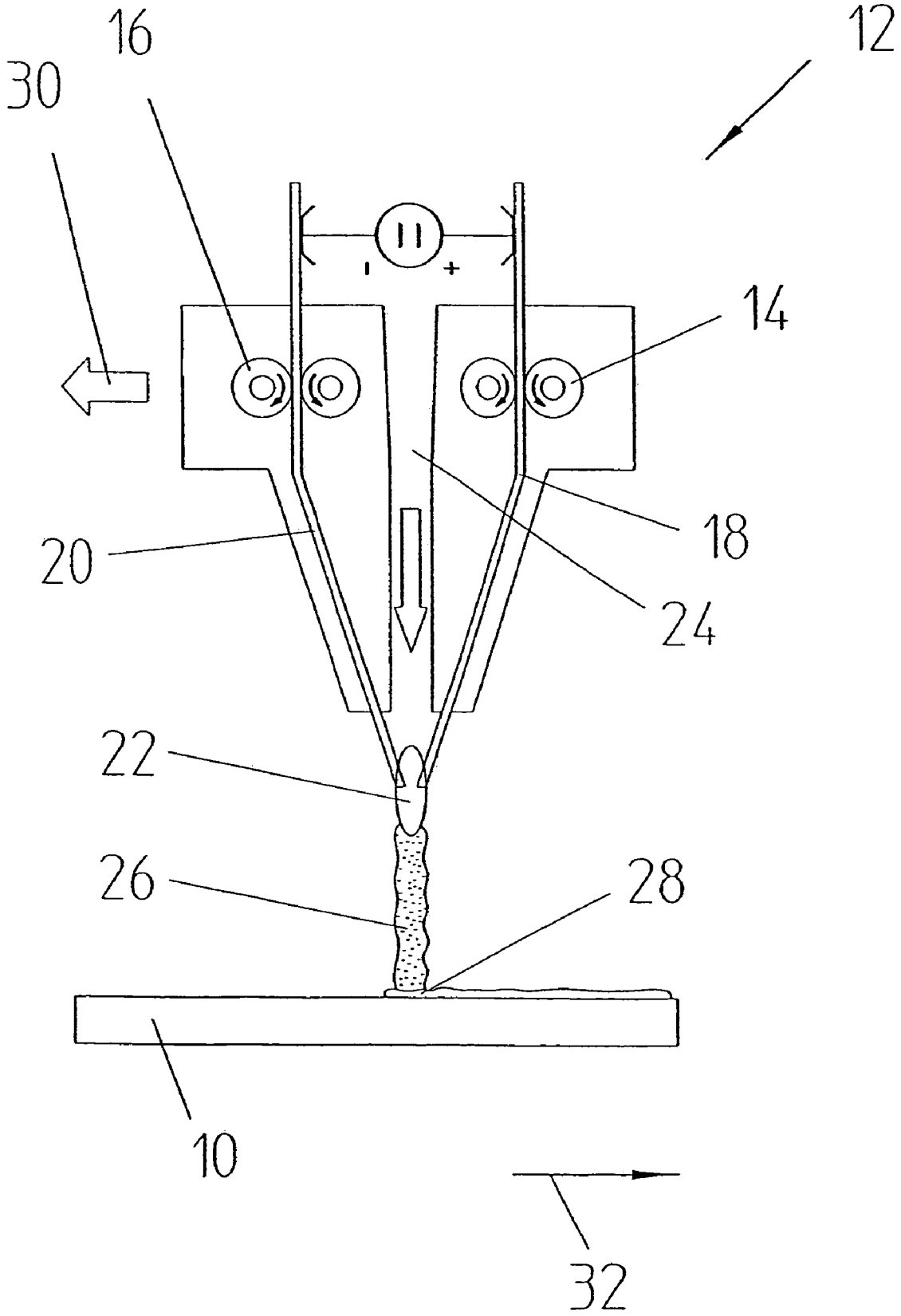
16
12
30
14
18
20
24
22
26
28
10
32

METHOD FOR COATING A SURFACE OF A TRACK COMPONENT, IN ADDITION TO A TRACK COMPONENT

The invention relates to a method of coating a surface of a track component having an aluminum-containing coating by means of an arc spraying process. The invention also relates to a track component, such as a switch component, with an aluminum-containing coating applied by an arc spraying process.

A slide chair is known from DE 38 05 963 A2 in which a lubricant is applied by a plasma or flame spraying process, the lubricant containing molybdenum or ternary or quarternary alloys based on Co or Ni, optionally with additives such as Mo, Cr and/or Si.

A sectional rail for a monorail having a bearing surface which is horizontal in cross section and to which a metal is applied by a flame spraying or arc spraying process can be found in DE 38 41 044 C2. The metal surfacing in that case comprises an adherence layer and a wear layer which contains 10% to 25% chromium. The adherence coating itself is preferably composed of 60% to 90% nickel and 10% to 40% aluminum. The thickness of the metal coating can be between 0.3 mm and 5 mm.

The disadvantage of a corresponding metal coating applied by an arc spraying process is that it is double-layered, the sliding and abrasive wear not being substantially increased in comparison to those coatings consisting of molybdenum which are applied by flame spraying, yet are single-layered.

The present invention is based on the problem of further developing a method of coating a surface of a track component as well as the track component itself in such a way that a coating can be formed in a technically simple manner, the coating having a high resistance to sliding and abrasive wear and, in particular, a high corrosion resistance to atmospheric electrolytes such as e.g. salt water or de-icing agents. A good adherence should also be provided.

According to the invention, the problem is substantially solved, by a method of the aforementioned type, in that aluminum and silicon are applied to the surface in a ratio of $3:2 \leqq Al:Si \leqq 4:1$ by arc spraying. In particular, aluminum is applied in a ratio of 3:1 to silicon.

The thickness of the coating comprising or containing aluminum and silicon should be between 0.2 mm and 2 mm, in particular in the range between 0.8 mm and 1.5 mm. A good adherence was shown when the coating was applied to a high-strength steel such as St 52.

According to the invention, aluminum and silicon are applied, in particular, to switch parts such as slide chairs or switch locks, such as can be found e.g. in EP 0739804, whereby the desired higher resistances to sliding and abrasive wear as well as high corrosion resistance can be obtained even with extremely small thicknesses. Substantial advantges are thereby provided, in particular in comparison to the previously known coating substances such as molybdenum and bronze. However, advantages are also shown in comparison to the multicoating structure according to DE 38 41 044 C2, insofar as only one coating is required which also meets all requirements when the coating thicknesses are only between 0.8 mm and 1.5 mm.

Cost-related advantages also result in comparison to e.g. nickel and aluminum or molybdenum substances, which are used according to the state of the art.

A track component such as a switch component or switch locking parts having a coating containing aluminum applied by an arc spraying process is distinguished in that this coating comprises or contains aluminum and silicon in a ratio of $3:2 \leqq Al:Si \leqq 4:1$, in particular, wherein aluminum is in a ratio of 3:1 to silicon.

In this case, a sheathed wire having a sheathing of aluminum and powdered silicon incorporated therein is preferably used as spray wire for the arc spraying process. Furthermore, the melted aluminum and silicon should be applied to the surface at a feed pressure of 2 to 4 bar over atmospheric pressure to obtain the desired adhesion. The coating should thereby be applied to the surface with a thickness d of $0.2\ mm \leqq d \leqq 2\ mm$, preferably $0.8\ mm \leqq d \leqq 1.5\ mm$.

The sheathed wire serving as the spray wire is conveyed to the arc with a wire feed rate V, where $1\ m/sec. \leqq V \leqq 15\ m/sec.$, preferably $6\ m/sec. \leqq V \leqq 8\ m/sec.$, whereby a voltage difference U, where $30\ V \leqq U \leqq 50\ V$, in particular $U \approx 40\ V$, should be set between the spray wires. To melt the aluminum and silicon, a current I, where $200/A \leqq I \leqq 600\ A$, in particular $250\ A \leqq I \leqq 500\ A$, should flow between the spray wires.

Further details, advantages and features of the invention can not only be found in the claims, the features found in said claims, alone or in combination, but also in the following description of a preferred embodiment found in the drawing.

A basic representation of a device for applying a spray coating to a track part in the form of a slide chair 10 is shown in the only figure. A device 12 in which spray wires 18, 20 can be moved together relative to the slide chair 10 via wire feed devices 14, 16 is directed towards the slide chair 10. Since a voltage V of between 30 V and 50 V, in particular about 40 V, prevails between the spray wires 18, 20, an arc 22 can form between the spray wires 18 and 20 to melt the arc material. This takes place, as a result of the prevailing voltage difference when an arc forms between the spray wires 18, 20, which, due to their different potentials, have the function of an anode and cathode in the area of the tips 22. A current I between 200 A and 600 A therefore flows, with the result that a temperature of about 4000° C. is produced, which leads to the desired melting of the spray wires. Gas is simultaneously conveyed to the arc 22 between the spray wires 18, 20 via a channel 24 at a pressure of preferably 3 to 4 bar, so that a spray jet 26 is formed which is deposited as a coating 28 on the slide chair 10.

To ensure that the coating 28 is formed uniformly and to the desired extent, the device 12, in direction of arrow 30, and/or the slide chair 10, in direction of arrow 32, are moved relative to one another at a desired velocity $V_G$, where $600\ mm/sec. \leqq V_G \leqq 1300\ mm/sec.$ The spray wires 18, 20 are sheathed wires having a sheathing consisting of aluminum with powdered silicon therein. The ratio of aluminum and silicon is thereby set in such a way that the spray jet 26 has a composition of aluminum and silicon in the ratio of between 3:2 and 4:1, in particular 3:1.

As a result, the coating 28 obtains a high resistance to sliding and abrasive wear as well as a high corrosion resistance to atmospheric electrolytes such as salt water and de-icing agents. Furthermore, a high adherence results on the surface of the slide chair.

The sheathed wires or spray wires 18, 20 are fed to the arc 22 via the feed device 14, 16 at a velocity of, in particular, $30\ mm/sec. \leqq V \leqq 100\ mm/sec.$

The invention claimed is:

1. A method of coating a surface of a steel track component comprising applying a coating comprising aluminum and silicon by means of an arc spraying process, wherein the aluminum and silicon are applied to the surface in a ratio of 3:2≦Al:Si≦4:1.

2. The method according to claim 1, wherein the aluminum and silicon are applied in a ratio of Al:Si of about 3:1.

3. The method according to claim 1, wherein the arc spraying process uses sheathed wires comprising a sheathing of aluminum and powdered silicon within the sheathing, as spray wires.

4. The method according to claim 1, wherein the arc spraying process comprises applying melted aluminum and silicon to the surface at a feed pressure of 2 to 4 bar over atmospheric pressure.

5. The method according to claim 1, wherein the coating is applied to the surface with a thickness d of 0.2 mm ≦d≦2 mm.

6. The method according to claim 5, wherein 0.8 mm≦d≦1.5 mm.

7. The method according to claim 3, wherein the arc spraying process comprises feeding the sheathed wires to the arc at a wire feed velocity of 1 m/sec.≦v≦15 m/sec.

8. The method according to claim 7, wherein 6 m/sec≦V≦8 m/sec.

9. The method according to claim 3, wherein the arc spraying process comprises setting a voltage difference U between the spray wires, where 30 V≦U≦50 V.

10. The method according to claim 9, wherein U is about 40 V.

11. The method according to claim 3, wherein the arc spraying process comprises passing a current I between the spray wires, where 200 A≦I≦600 A, in order to melt the wires.

12. The method according to claim 11, wherein 250 A ≦I≦500 A.

13. A steel track component comprising an aluminum-containing surface coating applied by an arc spraying process, wherein the coating comprises aluminum and silicon in a ratio 3:2≦Al:Si≦4:1.

14. The track component according to claim 13, wherein the track component is a slide chair or switch lock.

15. The track component according to claim 13, wherein the ratio is 3:1.

16. The track component according to claim 13, wherein the coating has a thickness d, where 0.2 mm≦d≦2 mm.

17. The track component according to claim 16, wherein 0.8 mm≦d≦1.5 mm.

18. The track component according to claim 13, wherein the steel is high-strength steel St 52.

19. The track component according to claim 13, wherein the coating is a single coating.

* * * * *

UNITED STATES PATENT AND TRADEMARK OFFICE

CERTIFICATE OF CORRECTION

PATENT NO. : 7,056,596 B2
APPLICATION NO. : 10/514242
DATED : June 6, 2006
INVENTOR(S) : Walter Kunitz et al.

It is certified that error appears in the above-identified patent and that said Letters Patent is hereby corrected as shown below:

Title page after (73) change "VAE GmbH, Vienna (AU)" to --VAE GmbH, Vienna (AT)--.

Signed and Sealed this

Seventeenth Day of October, 2006

JON W. DUDAS
*Director of the United States Patent and Trademark Office*